US005197404A

United States Patent [19]

Haley et al.

[11] Patent Number: 5,197,404

[45] Date of Patent: Mar. 30, 1993

[54] RAFT FASTENER

[76] Inventors: David J. Haley, 1600 First Ave. W. #406, Bradenton, Fla. 34205; Marsden W. Simmons, 4014 Bayshore Rd., Sarasota, Fla. 34234

[21] Appl. No.: 782,600

[22] Filed: Oct. 25, 1991

[51] Int. Cl.[5] ..... A47G 9/06

[52] U.S. Cl. ..... 114/267; 24/324; 24/697.1

[58] Field of Search ..... 403/388, 360, 373; 24/671, 662, 681, 624, 664, 669, 675, 682, 683, 685, 324, 168 B, 453, 697; 114/264–267; 441/65, 75, 50; 411/509, 508, 510, 500

[56] References Cited

U.S. PATENT DOCUMENTS

| | | | |
|---|---|---|---|
| 1,321,974 | 11/1919 | Bourque | 24/675 |
| 1,343,506 | 6/1920 | Hawkins | 24/675 |
| 1,734,048 | 11/1929 | Reiter | 24/324 |
| 3,869,766 | 3/1975 | Raymond | 24/662 |
| 3,975,803 | 8/1976 | Katayama | 24/689 |
| 4,604,962 | 8/1986 | Guibault | 114/219 |
| 4,878,258 | 11/1989 | Casey | 24/697 |

FOREIGN PATENT DOCUMENTS

| | | | |
|---|---|---|---|
| 0385903 | 9/1990 | European Pat. Off. | 114/266 |
| 1-273783 | 11/1989 | Japan | 114/266 |

*Primary Examiner*—Joseph F. Peters, Jr.
*Assistant Examiner*—Clifford T. Bartz
*Attorney, Agent, or Firm*—Rhodes, Coats & Bennett

[57] ABSTRACT

The present invention entails a fastener unit for coupling two or more rafts together. In one embodiment the fastener unit is comprised of a pair of deformable closed walls, each having a central opening and designed to lock one in another. Each closed wall includes a connector extending therefrom for connecting to a raft. In a second embodiment, the fastener unit is comprised of a pair of fasteners, each having an eyelet with a flexible hook extending therefrom. The hook is extended from one eyelet and is connected to a second eyelet, and a hook from the second eyelet is extended back to the first eyelet to form a coupled relationship between the two fasteners. Each hook and eyelet fastener having a connector extending therefrom for connecting to a raft.

3 Claims, 6 Drawing Sheets

RAFT FASTENER

FIELD OF THE INVENTION

The present invention relates generally to recreational floatation devices and more particularly to connection devices for recreational flotation devices.

BACKGROUND OF THE INVENTION

Water recreation is an important form of socialization and recreation. One piece of equipment typically used for water recreation is an inflatable raft used by individuals to float in the water. The most prevalent type of raft used is the inflatable raft designed to comfortably support an individual in a fully reclined position. These individual rafts are popular because they are inexpensive and convenient to both inflate and transport.

One problem with the individual raft is that two or more individuals often desire to float together on the water for safety reasons and so that they can easily talk and socialize. Individual rafts will not comfortably support two individuals in a fully reclined position. To accommodate the desire of individuals to float together on the water, larger rafts have been designed that will comfortably support two or more individuals floating on the water.

These larger rafts that permit two or mroe people to float together on the water have problems. First, this larger type is more difficult to inflate and transport than a raft designed for a single person. In addition, a larger raft permitting more than one person to stay in close proximity while floating on the water is typically more expensive than a raft designed for one person. Further, when used by a single person a larger raft normally is not as comfortable or as maneuverable as an individual raft. Accordingly, an improved raft design solving these problems is needed.

SUMMARY AND OBJECTS OF THE INVENTION

The present invention is a raft designed with one or more fasteners attached at the raft's border and designed to mate with a like fastener attached to another raft. A raft user can bring together two rafts that both have the raft fasteners of the present invention and easily connect together the raft fasteners from the adjacent rafts together to form a fastener unit which couples the two rafts securely together. The raft fasteners permit a raft user to float alone on an individual raft or interconnect his raft to one or more rafts to temporarily create a larger raft consisting of interconnected individual rafts and capable of comfortably supporting more than one individual.

There are three embodiments of the present invention fastener that can be used to form a secure fastener unit which couples rafts together. All three embodiments of the fastener are made using a soft construction of a resilient material such as PVC. The fastener's resilient material has the desired properties of being temporarily deformable from an original position, but continuously tending to recoil or return back to it's original shape once deformed. Likewise, the fastener is corrosion resistant to withstand harsh water environments and has a soft construction with no sharp or hard edges that may scratch soft objects or harm an individual.

The design of the raft fasteners allows the raft user to easily connect the raft fasteners while the user is floating on rough water. No tools are required to connect or disconnect the fasteners and the necessary steps for connection or disconnection of the fasteners can all easily be done by hand. In addition, the fasteners attached to rafts to be connected are interchangeable and androgynous. This interchangeability of mating fasteners allows a user to more easily connect the fasteners.

The fastener of the first embodiment includes a closed wall having a hour glass shape and a lock pin or plug adapted to be inserted into the hour glass shaped closed wall. A central opening is encompassed by the wall and extends between opposite ends of the wall. A fastener wall attached to one raft is inserted in the central opening of a fastener connected to another raft. The outer fastener deforms when the inner fastener is inserted therein and the two fasteners are snapped together to form a nested position. The lock pin or plug is inserted into the central opening of the inner fastener causing the resilient material of the fastener walls to compress against the plug to form a secure locked position which couples the rafts together.

The structure of the fastener of the second embodiment is similar to the first but includes a wall top that completely encloses the central opening at one end of the wall. When a fastener is inserted into a like fastener having this design, the wall top stretches and provides a compressive force against the inner fastener to provide a secure locked fastener unit. The additional compression between the mated fasteners provided by the wall top eliminates the need of a lock pin.

The third embodiment of the raft fastener is a hook and eyelet fastener. The hook and eyelet fastener includes an eyelet integrally attached to the border of a raft and a hook extending from the eyelet. The hook is inserted into the eyelet of a like fastener attached to a second raft and the second raft's hook is inserted into the eyelet of the first raft. The hooks engage their respective eyelets and a secure fastener unit is formed. The border of a raft may include a plurality of hook and eyelet fasteners that may be mated with a plurality of hook and eyelet fasteners attached to the border of a second raft.

The raft fasteners of all three embodiments are specifically designed for connecting rafts together. However, the fasteners are functional in other situations requiring easy to use mating fasteners.

It is therefore an object of the present invention to provide a fastener for efficiently connecting two or more rafts together.

Still a further object of the present invention is to provide a raft fastener that can be easily manipulated such that the fastener can be connected or unconnected to a second fastener in difficult conditions.

Another object of the present invention is to provide a fastener that is corrosion resistant and can withstand a water environment.

Still a further object of the present invention is to provide a raft fastener having a soft construction and a shape that is safe and will not injure a person.

Another object of the present invention is to provide a raft fastener that will not mark or scratch soft objects.

Still a further object of the present invention is to provide a raft fastener that a user can connect or disconnect by hand in rough water conditions without the use of tools.

Another object of the present invention is to provide mating fasteners that are interchangeable and androgynous for simple connection of raft fasteners.

Another object of the present invention is to provide a fastener that is economical to manufacture.

Other objects and advantages of the present invention will become apparent and obvious from a study of the following description and the accompanying drawings which are merely illustrative of such invention.

DETAILED DESCRIPTION OF THE INVENTION

Figure 2:
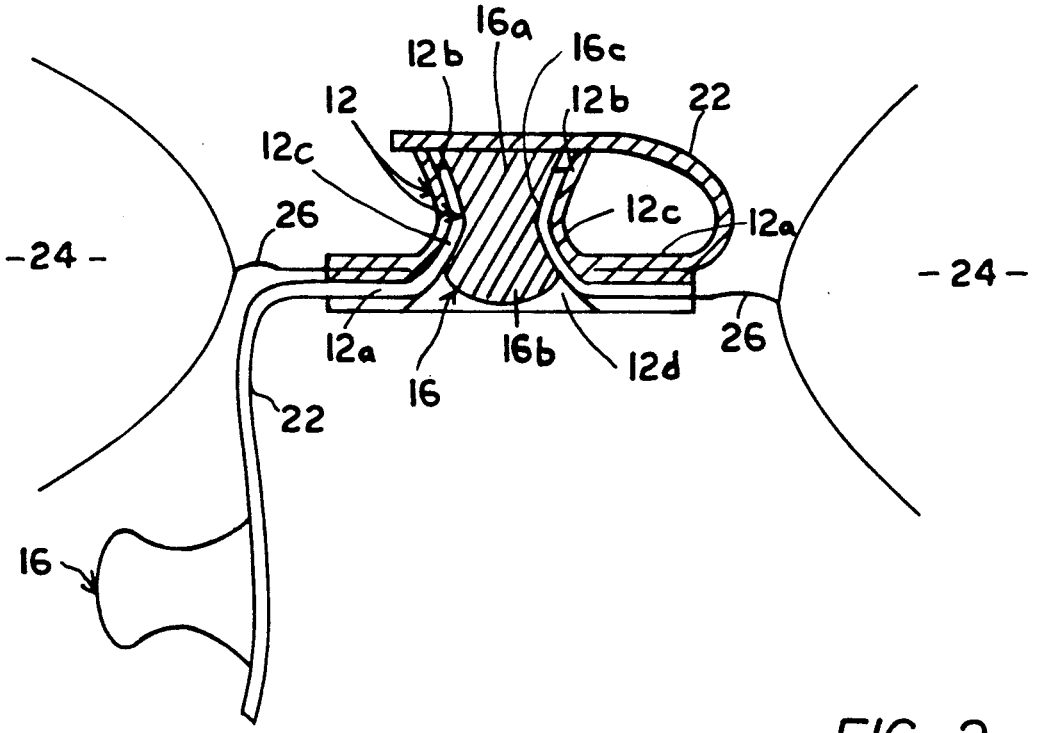
FIG. 2 is a transverse sectional view of the two fasteners shown in FIG. 1 in a connected, locked position.
Figure 4:
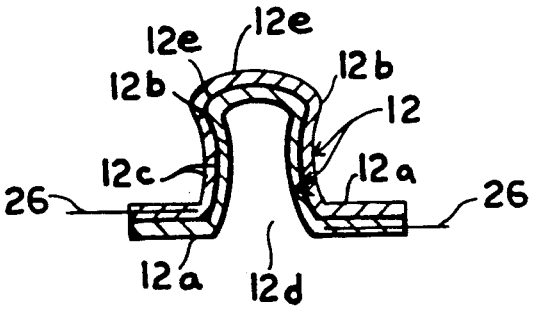
FIG. 4 is a transverse sectional view of a pair of fasteners of the second embodiment in a connected, locked position.

With further reference to the drawings the raft fastener of the present invention is shown therein and indicated generally by the numeral 10. As illustrated in FIGS. 2 and 4, fastener 10 is designed to mate with a like fastener 10 to form a fastener unit.

Figure 1:
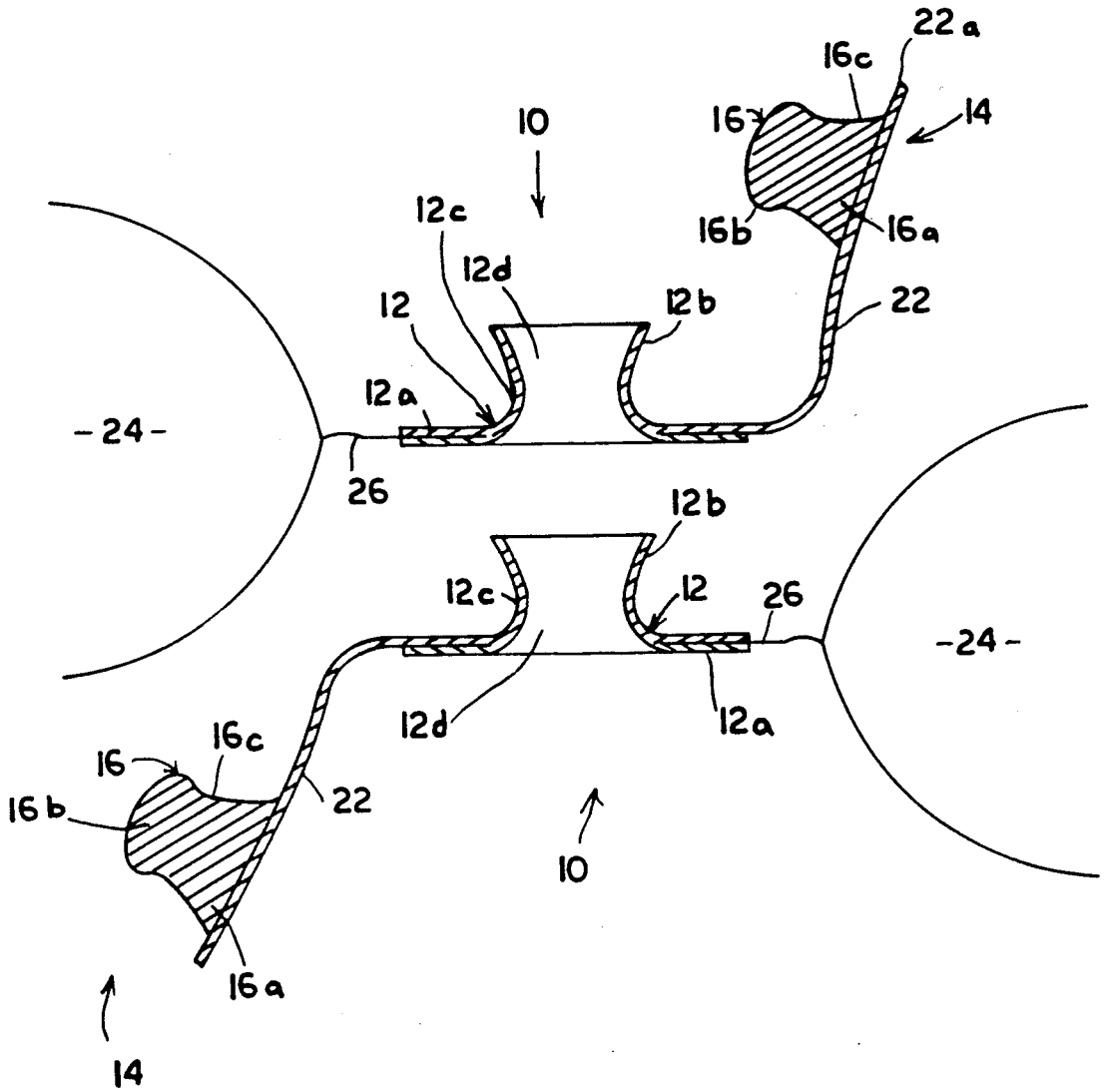
FIG. 1 is a transverse sectional view of two like fasteners that form a first embodiment of the present invention.

Viewing the first embodiment of fastener 10 shown in FIGS. 1 and 2 in more detail, it is shown that each fastener 10 includes a deformable closed wall structure 12. In the preferred embodiment, wall structure 12 is constructed of a resilient, deformable material such as a PVC material. This material enables wall structure 12 to retain it's original shape after a force compressing or stretching wall 12 is removed. Wall 12 includes a base or flange section 12*a*, a head section 12*b*, and an indented section 12*c* separating the head section 12*b* and the base section 12*a*. A central opening 12*d* extends completely through wall structure 12 from the base section 12*a* to the head section 12*b*.

Connected to base section 12*a* is a lock pin 14 which includes a solid plug 16 and a flexible connector 22. Plug 16 includes a base section 16*a*, a head section 16*b*, and an indented section 16*c* separating head section 16*b* and base section 16*a*. Flexible connector 22 attaches to plug base 16*a* and extends to base section 12*a* of wall 12, coupling plug 16 to the deformable wall 12.

The attachment and operation of mating fasteners 10, as illustrated in FIGS. 1 and 2, is as follows. As FIG. 1 shows, a user places two rafts 24, each having a fastener 10, adjacent to each other and positions the deformable wall 12 of one fastener 10 beneath the deformable wall 12 of a second fastener 10. In order to snap the two deformable walls 12 together in a snug insert or nesting position, the user inserts by hand the head section 12*b* of the bottom fastener 10 into the central opening 12*d* at the base 12*a* of the other fastener wall 12. Due to the interchangeability of the fasteners 10, either fastener 10 can be inserted into the other fastener 10. While pushing the deformable wall 12 of the inner fastener 10 through the outer fastener's central opening 12*d*, the indented section 12*c* of the outer fastener 10 compresses the deformable head section 12*b* of the inner fastener 10.

The compression of the inner fastener's wall 12 as head section 12*b* passes through the tapering central opening 12*d* allows the inner fastener's head section 12*b* to pass through the relatively narrow passage at the indented section 12*c*. Once the inner fastener's head section 12*b* passes the outer fastener's indented wall section 12*c* of the central opening 12*d* and into the wider central opening 12*d* passage of the head section 12*b*, the resilient material of inner wall 12 causes head section 12*b* to recoil against the outer wall's head section 12*b*. The user continues pushing the deformable walls 12 together until the respective bases 12*a* are adjacent one another and there is a snug fit between the wall sections 12, as shown by FIG. 2.

To place the fasteners 10 in a locked position, the user inserts the plug 16 of lock pin 14 into the snugly fitted deformable walls 12. This locked position is achieved by positioning the plug's head section 16*b* adjacent to the nested walls' head sections 12*b* and pushing the plug 16 through the inner fastener's central opening 12*d*. The relatively large diameter of the plug's head section 16*b* as compared to the tapering diameter of the central opening 12*d* causes head section 16*b* to increasingly expand the deformable nested walls 12 as the head section 16*b* passes through the central opening 12*d* encompassed by the walls' head sections 12*b*.

As the plug's insert heat 16*b* pases into the walls' indented sections 12*c*, the diameter of the central opening 12*d* gradually increases allowing the resilient wall material of the nested walls 12 to spring back towards their original position. The resilient walls' recoil causes the walls' nested head sections 12*b* to compress against the plug's indented section 16*c* and the walls' indented sections 12*c* to press against the plug's insert head 16*b*. The user continues to insert the lock pin 14 until the plug's base 16*a* is adjacent the top of the deformable walls' head section 12*b* and the fasteners 10 are in the locked fastener position shown in FIG. 2.

Raft connectors 26 attach each fastener 10 to it's respective raft 24 and when the fasteners 10 are in the locked position the two rafts 24 are securely coupled together. The user can uncouple the rafts 24 by first gripping raft connector end 22*a* and pulling plug 16 from the central opening 12*d* of the nested walls 12. The nested walls 12 are then easily pulled apart to detach the fasteners 10 and uncouple the rafts 24. The resilient material of the fastener walls 12 allows repeated coupling and uncoupling of the fasteners 10 and their respective rafts 24.

Figure 3:
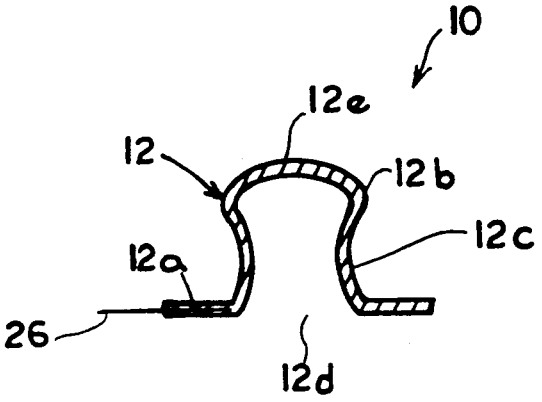
FIG. 3 is a transverse cross-sectional view of a second embodiment of the fastener of the present invention.

Turning to FIGS. 3 and 4, there is shown a second alternate fastener 10 design. Like the fastener 10 design of the first embodiment, the alternate fastener 10 includes a deformable wall structure 12 made of a resilient, deformable material such as PVC and is also connected to a raft 24 by raft connector 26. Wall 12 includes a base section 12*a*, a head section 12*b*, and an indented section 12*c* separating the base section 12*a* and the head section 12*b*. Central opening 12*d* extends from the wall's base section 12*a* and extends into the head section 12*b*.

The second embodiment of fastener 10 differs from the first embodiment in that no lock pin 14 is used and the head section includes a closed top 12*e*. Closed top 12*e* is integral with head section 12*b* and completely encloses the portion of the central opening 12*d* extending into the head section 12*b*. Head section top 12*e* is made of a resilient material which allows the head section top 12*e* to stretch and accommodate a like fastener 10 inserted through it's central operation 12*d*, as shown in FIG. 4. The resiliency of the head section top 12*e* also causes additional compression of the outer fastener walls 12 against the inner fastener walls 12, resulting in additional fastening strength when two fasteners 10 are in a nested position and eliminating the need for a lock pin 14. As well known in the relevant art, the thickness of head section top 12*e* and walls 12, in general, can be varied to provide the desired stretchability and compressibility of fasteners 10.

The attachment and operation of the design shown in FIGS. 3 and 4 operates similar to the design shown in FIGS. 1 and 2. As shown in FIG. 4, the head section top 12*e* of the outer wall 12 is stetched when a user inserts a like size fastener 10 into the central opening 12*d* of outer fastener 10. Head section 12*b* being closed provides additional compressive stength to outer fastener wall 12, as compared to a fastener 10 having an open head section 12*b*. This additional compressive stength causes outer wall 12 to be securely compressed against the inner fastener's wall 12 for a secure snap fit between the two fasteners 10 which eliminates the need for a lock pin 14.

Figure 5:
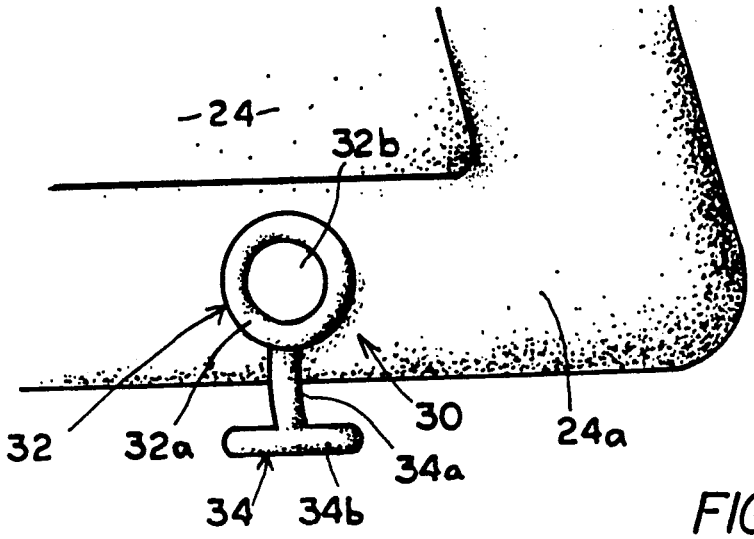
FIG. 5 is a fragmentary top plan view of a raft showing a fastener of a third embodiment incorporated therein.
Figure 6:
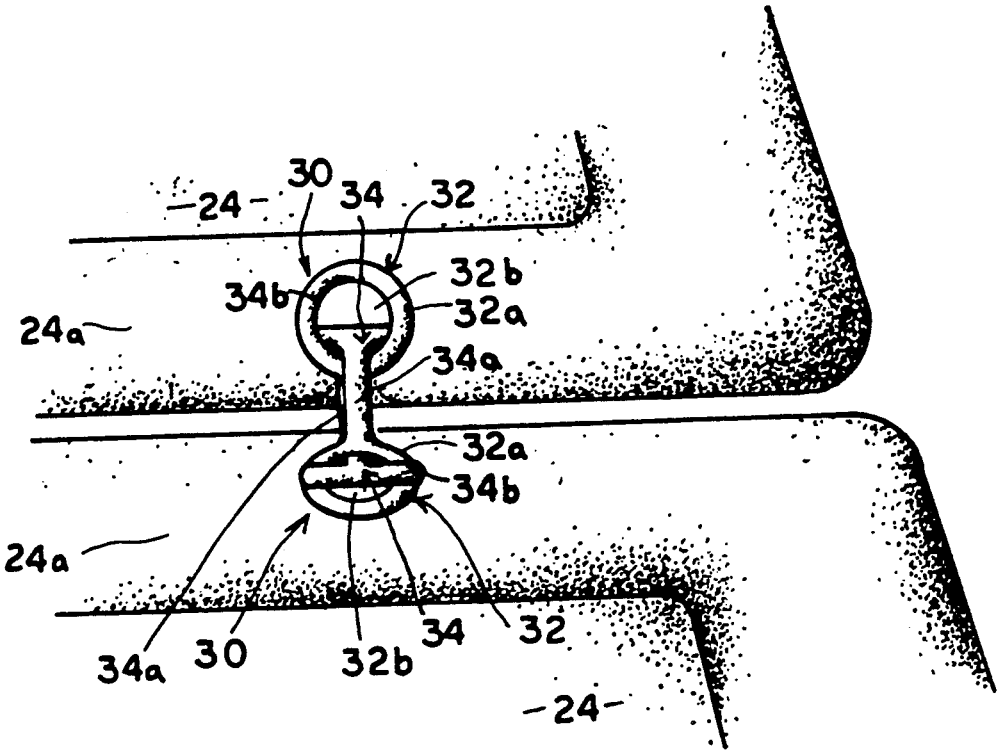
FIG. 6 is a fragmentary top plan view of two rafts coupled together by fasteners shown in FIG. 5.
Figure 7:
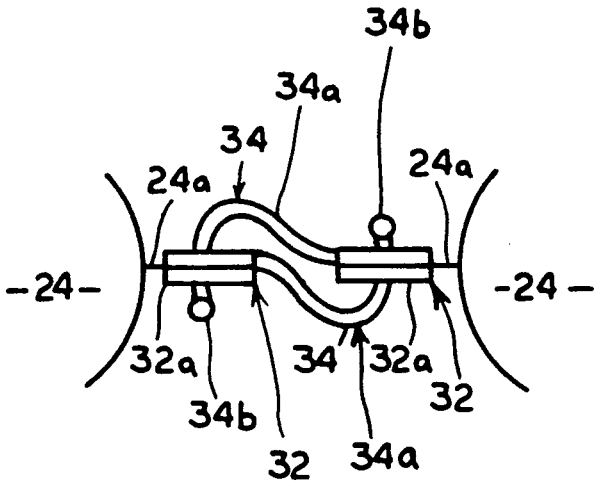
FIG. 7 is a side view of two coupled fasteners having the design shown in FIG. 6 with a modification in how the fasteners are connected to the rafts.
Figure 8:
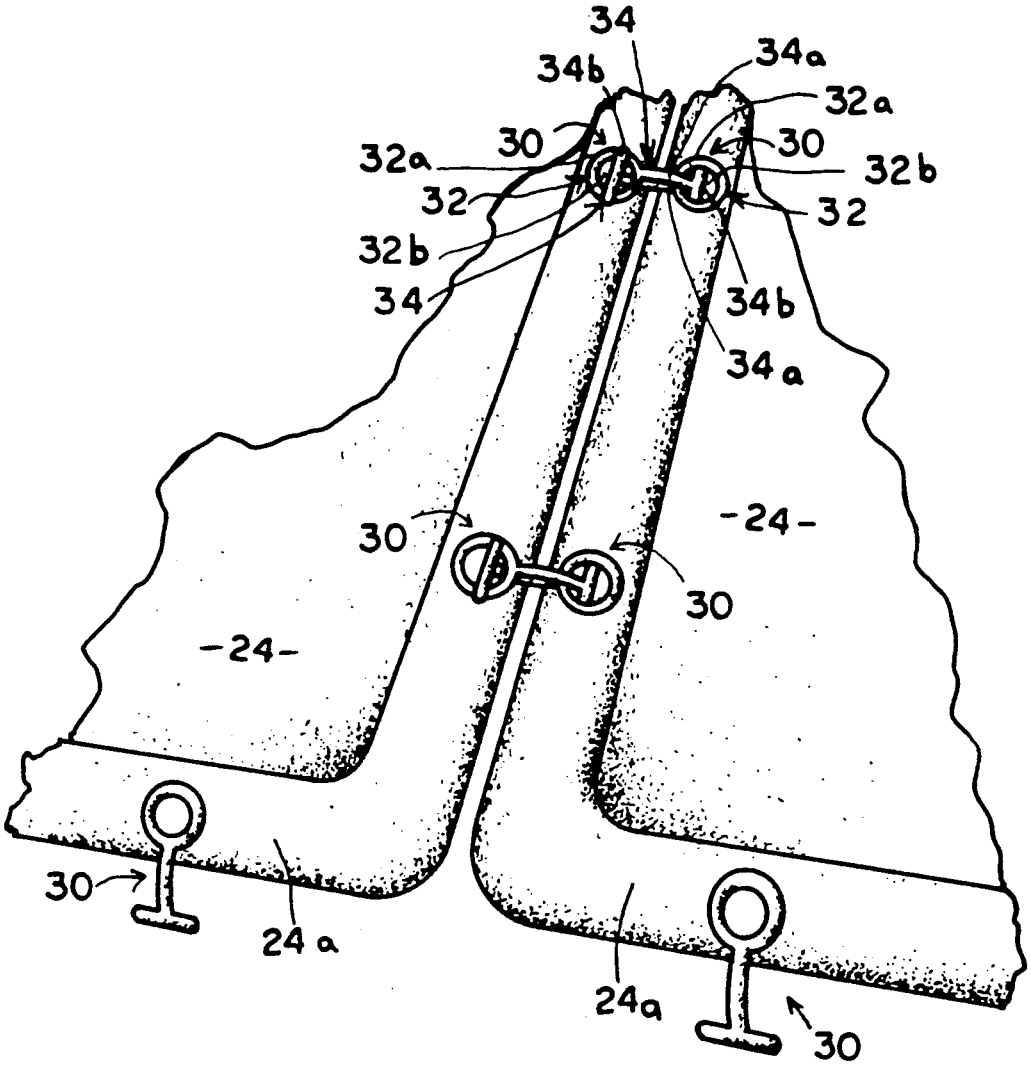
FIG. 8 is a fragmentary top plan view illustrating two rafts coupled together by the fastener design shown in FIGS. 5-7.

A third embodiment of a fastener unit of the present invention entails a raft 24 with a hook and eyelet fastener 30 shown in FIGS. 5–8. As shown in FIG. 8, a plurality of hook and eyelet fasteners 30 are attached to a fastener border 24*a* along the border of a raft 24. Hook and eyelet fasteners 30 each include an eyelet 32 attached to fastener border 24*a* and a flexible hook 34 extending therefrom. Eyelet 32 can be attached to raft 24 in two different manners. As shown in FIGS. 5, 6, and 8, eyelets 32 is attached at approximately the center of the width of raft border 24*a*. In addition, eyelet 32 can be attached to the edge of raft border 24*a*, as shown in FIG. 7.

Eyelet 32 includes an eyelet opening 32*b* and an eyelet border 32*a* surrounding eyelet opening 32*b* and attached to fastener border 24*a*. Flexible hook 34 includes a flexible connecting line 34*a* with one end attached to eyelet border 32*a* and an opposite end integral with a perpendicular and flexible securing or engaging member 34*b* having a length greater than the diameter of eyelet 32. Hook and eyelet fastener 30 is made of a resilient material such as PVC. This resilient material allows a user to easily deform and manipulate the hook and eyelet fastener 30 by bending or compressing it, but the resilient material causes the hook and eyelet fastener 30 to recoil back to it's original shape, shown in FIG. 5, once the deforming force is removed.

The attachment and operation of this embodiment is shown in FIGS. 6–8. A user brings two rafts 24 together so that the fasteners 30 for each raft 24 are adjacent. The user then inserts the securing member 34*b* of the first fastener 30 through the top of the second fastener's eyelet opening 32*b*. Likewise, the user inserts the securing member 34*b* of the second fastener 30 through the bottom of the first fastener's eyelet opening 32*b*. As shown in FIG. 8, adjacent hook and eyelet fasteners may also be connected in a similar manner to more securely couple rafts 24.

Because each securing member 34*b* is attached to a connecting line 34*a* and has a greater diameter than the eyelet opening 32*b* in which it is inserted, the user must deform the securing member 34*b*, connecting line 34*a*, and/or the eyelet border 32*a* in order for each securing members 34*b* to be completely passed through the opposing eyelet border 32*a*. Once the user inserts the securing members 34*b* through the eyelets 32, the user may release the hook and eyelet fasteners 30 and the resilient material of hook and eyelet fasteners 30 will recoil back into their original, uncompressed state.

When in their original shape, the securing members' lengths across are greater than the diameter of eyelet openings 32*b* such that when the hook and eyelet fasteners 30 are pulled apart the securing members 34 are caught by eyelet borders 32*a* preventing the hooks 34 from disengaging eyelets 32. The connected hook and eyelet fasteners 30, each firmly attached to their respective rafts 24, provide a secure coupling of the two rafts 24.

Locating several hook and eyelet fasteners 30 along fastener border 24*a* of raft 24 has several advantages. First, a user can more securely attach two rafts 24 together by engaging several adjacent pairs of fasteners 30. Likewise, a user can vary the orientation of how two rafts 24 will be coupled by selecting which fasteners 30 will be coupled. Also, having several fasteners 30 located on raft 24 permits more than one raft 24 to be attached to a single raft 24.

The above description of fasteners 10 and 30 describes how the present invention gives a raft user an alternative to buying a large raft in order to support more than one individual comfortably in the water. Raft 24 having fasteners 10 or 30 gives an individual the option to use raft 24 while disconnected or connected to at least or e raft 24. The soft construction of fasteners 10 and 30 allow for the safety of individuals and makes manipulation of the fasteners 10 and 30 connecting mating fasteners 10 and 30 easily achieved by hand. Likewise, the interchangeability and structure of fasteners 10 and 30 make connection of fasteners 10 and 30 easier to achieve in rough water conditions. The fasteners 10 or 30 are functional in other situations requiring easy to use mating fasteners.

The present invention may, of course, be carried out in other specific ways than those herein set forth without departing the spirit and essential characteristics of the invention. The present embodiments are, therefore, to be considered in all respects as illustrative and not restrictive and all changes coming within the meaning and equivalency range of the appended claims intended to be embraced therein.

What is claimed is:

1. A raft having an integral fastener attachable to a like fastener of another raft for coupling two rafts comprising:

(a) a first raft having an outer border;

(b) a series of raft fasteners incorporated into the border of the first raft;

(c) each fastener including an eyelet having an eyelet border integrally mounted in the raft border and surrounding an eyelet opening, and an eyelet engaging means connected to the raft border and extending therefrom for coupling to a like eyelet;

(d) the eyelet engaging means of the raft fastener being insertable into the eyelet opening of a second raft and the eyelet engaging means of the second raft being insertable into the eyelet opening of the first raft to form a fastener unit that effectively couples the first raft with the second raft; and (e) the eyelet engaging means including a series of T-shaped connectors each having a flexible connecting line and a flexible and resilient securing line extending from the connecting line to form a hook, the flexible securing line normally assuming an elongated position and being insertable within an eyelet opening by bending the same after which the flexible securing line returns to its normal elongated position where the same extends across the eyelet opening and is secured therein whereby the first raft can be connected to a second raft by interconnecting the respective T-shaped connectors with respective eyelets.

2. An androgynous fastener unit comprising: first and second like fasteners connected together to form a fastener unit; each fastener being of a generally hourglass shape and including a deformable wall and a central opening formed therein, the wall including a base section, a head section, and an indented section formed between the base section and the head section; and wherein the first and second fasteners are interchangeably insertable within each other such that a snap-fit arrangement is achieved by inserting either fastener into the central opening of the other fastener, and wherein in a fastened state the respective indented sections of the walls lie adjacent each other while heat and base sections of the fasteners are positioned adjacent each other.

3. The fastener unit of claim 2 wherein each androgynous fastener includes a lock pin having a generally hourglass shape and including a head section, a base section and an indented section formed between the head and base sections, and wherein in a fastened state the lock pin projects through the innermost fastener such that the indented section of the innermost fastener lies adjacent the indented section of the lock pin and wherein the head and base sections of the lock pin lie adjacent to the head and base sections of the innermost fastener.

* * * * *